US007114911B2

(12) United States Patent
Martin et al.

(10) Patent No.: US 7,114,911 B2
(45) Date of Patent: Oct. 3, 2006

(54) VARIABLE CAMBER AND STAGGER AIRFOIL AND METHOD

(75) Inventors: Nicholas Francis Martin, Simpsonville, SC (US); Steven Mark Schirle, Anderson, SC (US)

(73) Assignee: General Electric Company, Schenectady, NY (US)

( * ) Notice: Subject to any disclaimer, the term of this patent is extended or adjusted under 35 U.S.C. 154(b) by 209 days.

(21) Appl. No.: 10/924,846

(22) Filed: Aug. 25, 2004

(65) Prior Publication Data

US 2006/0045728 A1 Mar. 2, 2006

(51) Int. Cl.
*F01D 9/04* (2006.01)

(52) U.S. Cl. ..... 415/1; 415/160

(58) Field of Classification Search ..... 415/1, 415/159, 160

See application file for complete search history.

(56) References Cited

U.S. PATENT DOCUMENTS

| | | | | |
|---|---|---|---|---|
| 3,318,574 | A * | 5/1967 | Tyler | 415/36 |
| 4,579,507 | A * | 4/1986 | Corrigan et al. | 415/150 |
| 4,995,786 | A | 2/1991 | Wheeler et al. | |
| 5,314,301 | A | 5/1994 | Knight | |
| 5,620,301 | A * | 4/1997 | Lawer | 415/150 |

* cited by examiner

*Primary Examiner*—Ninh H. Nguyen
(74) *Attorney, Agent, or Firm*—Nixon & Vanderhye P.C.

(57) ABSTRACT

Aerodynamically efficient air flow management in axial flow-turbines is provided by utilizing a variable stagger and camber airfoil. In an exemplary embodiment of the invention, this is accomplished by providing a two-piece airfoil including a strut and a flap, each of which is mounted to articulate about a common, radially oriented axis. The strut and flap are respectively positioned by a strut gear and a flap gear, located at the radial end of the airfoil and, in an exemplary embodiment, are driven by a stepped synchronizing ring.

16 Claims, 5 Drawing Sheets

VARIABLE CAMBER AND STAGGER AIRFOIL AND METHOD

BACKGROUND OF THE INVENTION

The present invention relates to a mechanical method to create a variable stagger and camber airfoil.

For power generation applications, limits on start time, grid demand response time, and maintenance factors create an environment where it is often advantageous to reduce the output of the gas turbine rather than shutting it down as demand is reduced. Axial flow industrial gas turbines modulate output levels by controlling the amount of air flow entering the compressor with inlet guide vanes.

The conventional "Inlet Guide Vane" (IGV) is a single stage of articulated airfoils (about a radial axis) located in the front of the axial flow compressor. The maximum amount of air flow occurs when the IGV chord is aligned, or parallel, with the incoming air flow. This flow is reduced as the IGV stagger angle is rotated to a more aerodynamically closed position. For purposes of the disclosure, the stagger angle ($\Theta_{Stagger}$) is defined as the angle between the air flow velocity vector and a straight line which connects the leading and trailing edge of the interconnected airfoils in the chordwise direction. The IGV operation is simple, but aerodynamically inefficient. In this regard, industrial gas turbines are designed to operate most efficiently at full power. As the output level is reduced, by limiting the incoming air flow the efficiency is also reduced. This efficiency loss is attributable to the aerodynamic inefficiencies associated with a conventional IGV configuration.

Conventional variable geometry compressor airfoils are limited to either stagger-only or camber-only changes. See in this regard U.S. Pat. No. 5,314,301 and U.S. Pat. No. 4,995,786. Thus, conventional variable geometry compressor airfoils do not have both variable camber and stagger control.

BRIEF DESCRIPTION OF THE INVENTION

The invention improves power turn down operational efficiency by aerodynamic optimal air flow advantage through a variable stagger and camber inlet guide vane airfoil configuration.

Thus, the invention may be embodied in a compressor stator vane for a gas turbine engine comprising: a leading edge part and a trailing part, each said part having a shaft-like portion extending through an outer diameter case wall of said gas turbine compressor, said leading edge part and said trailing edge part being mounted to articulate about a common, radially, oriented axis; a strut gear for selectively varying an angle of said leading edge part with respect to an inlet air flow vector by rotating said leading edge part with respect to said axis of rotation; and a flap gear for selectively rotating said trailing edge part about said axis of rotation to vary an angle of said trailing edge part with respect to said air flow vector. In an embodiment of the invention, a stepped, synchronous ring is provided for being driven to position said leading edge and trailing edge parts via said respective gears.

The invention may also be embodied in a method for changing stagger angle and camber angle of a compressor stator vane, comprising: providing an airfoil including: a leading edge part and a trailing part, each said part having a shaft-like portion extending through an outer diameter case wall of said gas turbine compressor, said leading edge part and said trailing edge part being mounted to articulate about a common, radially, oriented axis; a strut gear for selectively varying an angle of said leading edge part with respect to an inlet air flow vector by rotating said leading edge part with respect to said axis of rotation; and a flap gear for selectively rotating said trailing edge part about said axis of rotation to vary an angle of said trailing edge part with respect to said air flow vector, the method comprising driving said strut gear and said flap gear to determine a stagger angle and a camber angle of said airfoil. In an exemplary embodiment, a stepped, synchronous ring is provided for being driven to position said leading edge and trailing edge parts via said respective gears and the method further comprises rotating said stepped, synchronous ring to drive said strut gear and said flap gear.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
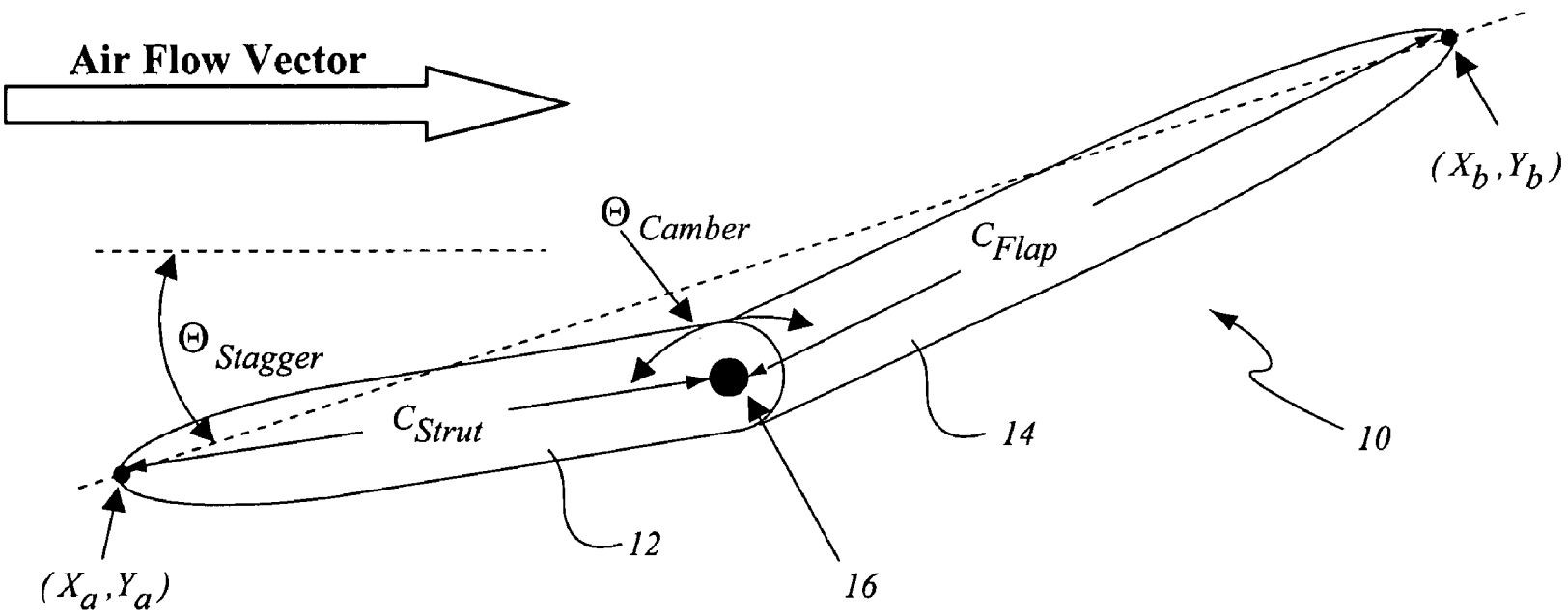
FIG. 1 is a schematic illustration of a two-piece variable stagger and camber airfoil embodying the invention.

Referring to FIG. 1, and as noted above, the stagger angle $\Theta_{Stagger}$ is defined by the angle between the airflow velocity vector and a straight line which connects the leading and trailing edge of the interconnected airfoils in a chordwise direction. Camber ($\Theta_{Camber}$) is defined as the angle between the leading edge part 12 and trailing edge part 14.

The present invention provides aerodynamically efficient air flow management in axial flow-turbines by utilizing a variable stagger and camber airfoil 10. In an exemplary embodiment of the invention, this is accomplished by providing a two-piece airfoil including a leading edge part 12, hereinafter referred to as the strut, and a trailing edge part 14, hereinafter referred to as the flap, each of which is mounted to articulate about a common, radially oriented axis 16.

Figure 2:
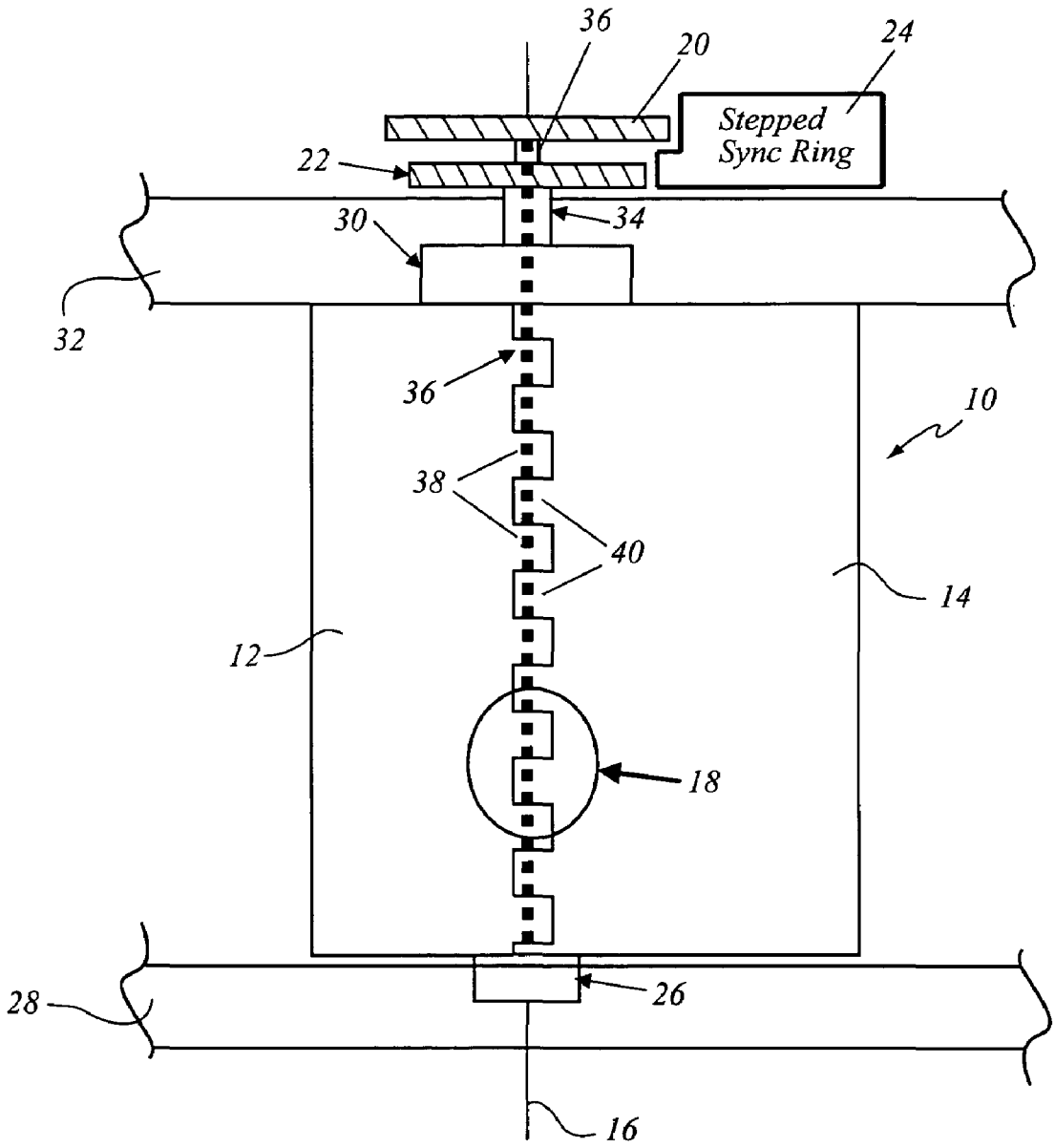
FIG. 2 is a schematic tangential view of a variable stagger and camber inlet guide vane embodying the invention.

As illustrated in FIG. 2, in an exemplary embodiment of the invention, the strut and flap define an interlocking hinge 18. The strut 12 and flap 14 are respectively positioned by a strut gear 20 and a flap gear 22, located at the radial end of the airfoil and in this embodiment are driven by a stepped synchronizing ring 24.

Figure 4:
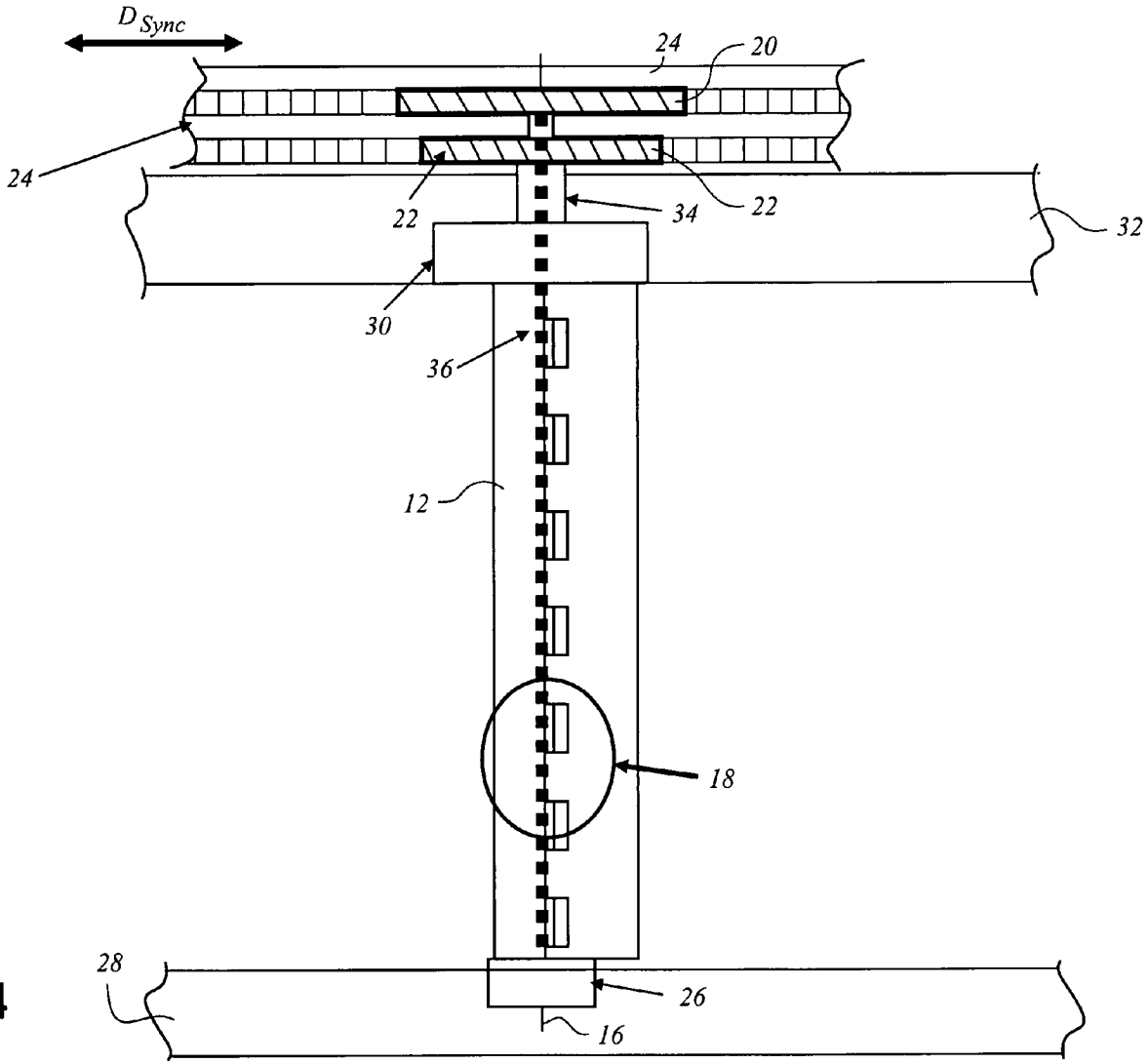
FIG. 4 is a schematic axial view of the variable stagger and camber inlet guide vane shown in FIG. 2.
Figure 5:
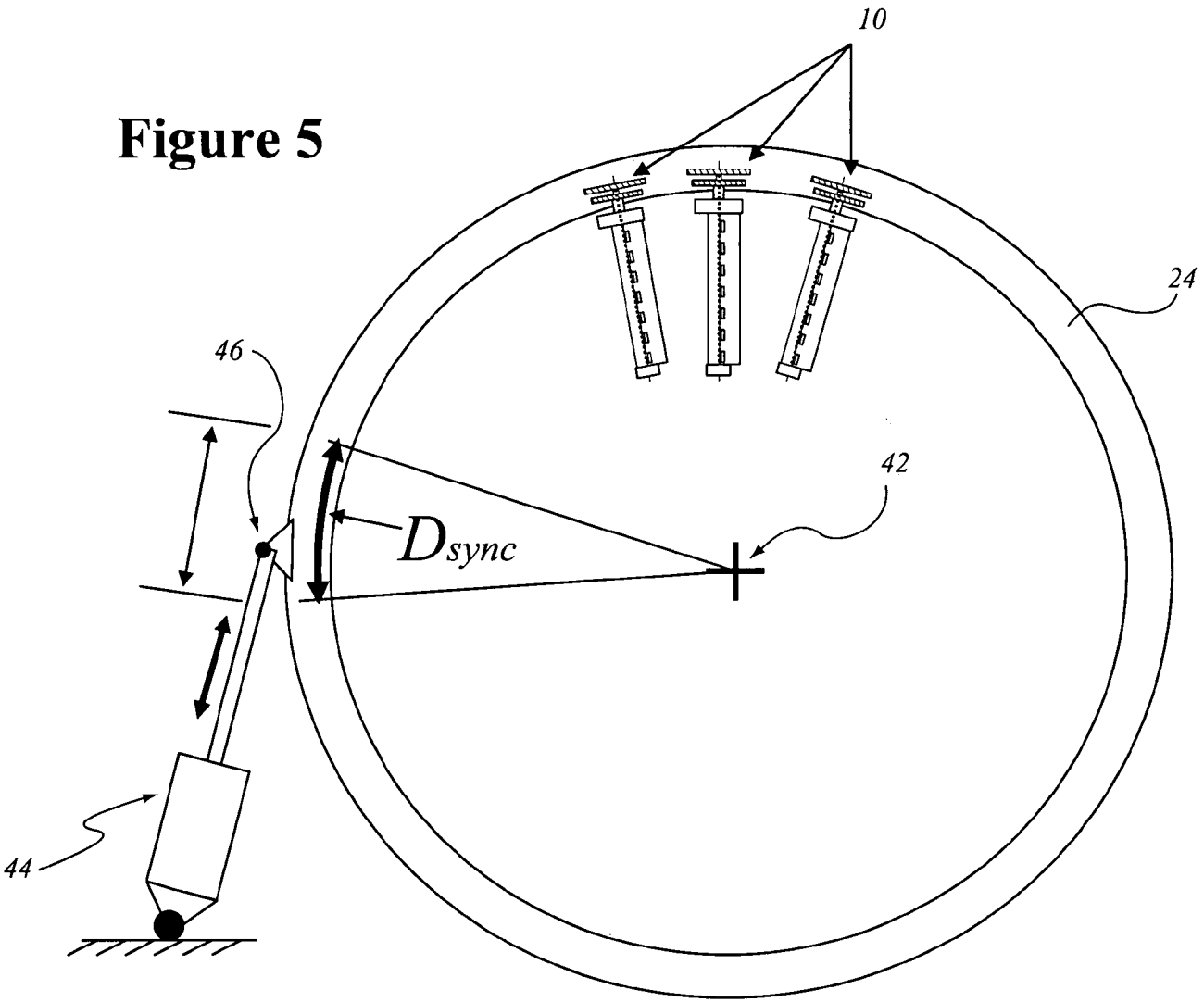
FIG. 5 is a schematic axial view of the stepped synchronous ring, taken from the front.

The stepped synchronous ring 24 is a full hoop structure that rotates about the engine centerline 42. More specifically, referring to FIGS. 2, 4, and 5, in an embodiment of the invention, the conventional ring is changed in that a second radially offset (FIG. 4) and axially stepped (FIG. 2) row of gear teeth have been added. The two rows of gear teeth on the sync ring mesh with the strut and flap gears. The ring is typically positioned aft of the IGV gears and therefore the forward facing side of this ring has the gear teeth that in turn mesh with each of the IGV gears (FIGS. 4 and 5). In previous industrial turbine applications the ring meshed with a single gear on the IGV and thus had only one row of matching gear teeth on the forward facing side. Note that the ring gear teeth could instead be on the aft face if the sync ring were positioned forward of the IGV gears.

The ring rotational movement is controlled by a linear actuation device 44, connected to the ring via a pivot linkage 46, as illustrated in FIG. 5. The ring is radially positioned around the compressor casing with close toleranced stand-ups (not shown) on the case that engage the ring. As the sync ring is actuated, it rotates about the engine center line 42, which in turn moves both the strut and flap gears through the same translational distance. Since the strut and flap gears are of different radii they will rotate through different angles.

The flap 14 is comprised of a flap inner diameter button 26 engaged with the inner diameter case wall 28, a flap outer diameter button 30 engaged with the outer diameter case wall 32, a flap shaft 34, and flap gear 22. In the illustrated embodiment, the flap shaft transmits the rotary movement of the flap gear to the flap via the flap outer diameter button fixedly disposed therebetween. The strut 12 on the other hand is interconnected to the strut gear 20 via a radially extending shaft structure 36, as illustrated in phantom in FIG. 2, fixed to the hinge part(s) 38 of the strut and, rotatably disposed through a central bore of the flap hinge part 40, flap outer diameter button 30, flap shaft 34 and flap gear 22.

In the schematic illustration of FIG. 2, the flap 14 is the airfoil part that contacts the inner diameter and outer diameter case segments 28,32 through the respective inner diameter and outer diameter buttons 26,30, thereby providing the needed axial and tangential positional constraints. The strut airfoil is connected to the flap via the interlocking hinge 18 and strut shaft 36. However, the strut could also include the constraint features if deemed necessary or desirable. In such a configuration the flap would then be interconnected to the strut via the interlocking hinge and a flap shaft. Thus, it is to be understood that the shaft and hinge configuration illustrated could be reversed in respect to the strut and flap. The interlocking hinge parts 38,40 that connect the flap and strut to the common radial axis of rotation are advantageously sized to provide load carrying capability, maximum durability, and to minimize air leakage.

As noted above, the stepped synchronization ring 24 may be provided as a modification of a conventional ring. Whereas the current synchronization ring engages only one gear on a conventional IGV configuration, the stepped sync ring provided in the embodiment of the invention engages both the strut and flap gears. The flap and strut gear radii determine the stagger and camber relationship as the sinc ring is tangentially articulated via the actuating system.

Figure 3:
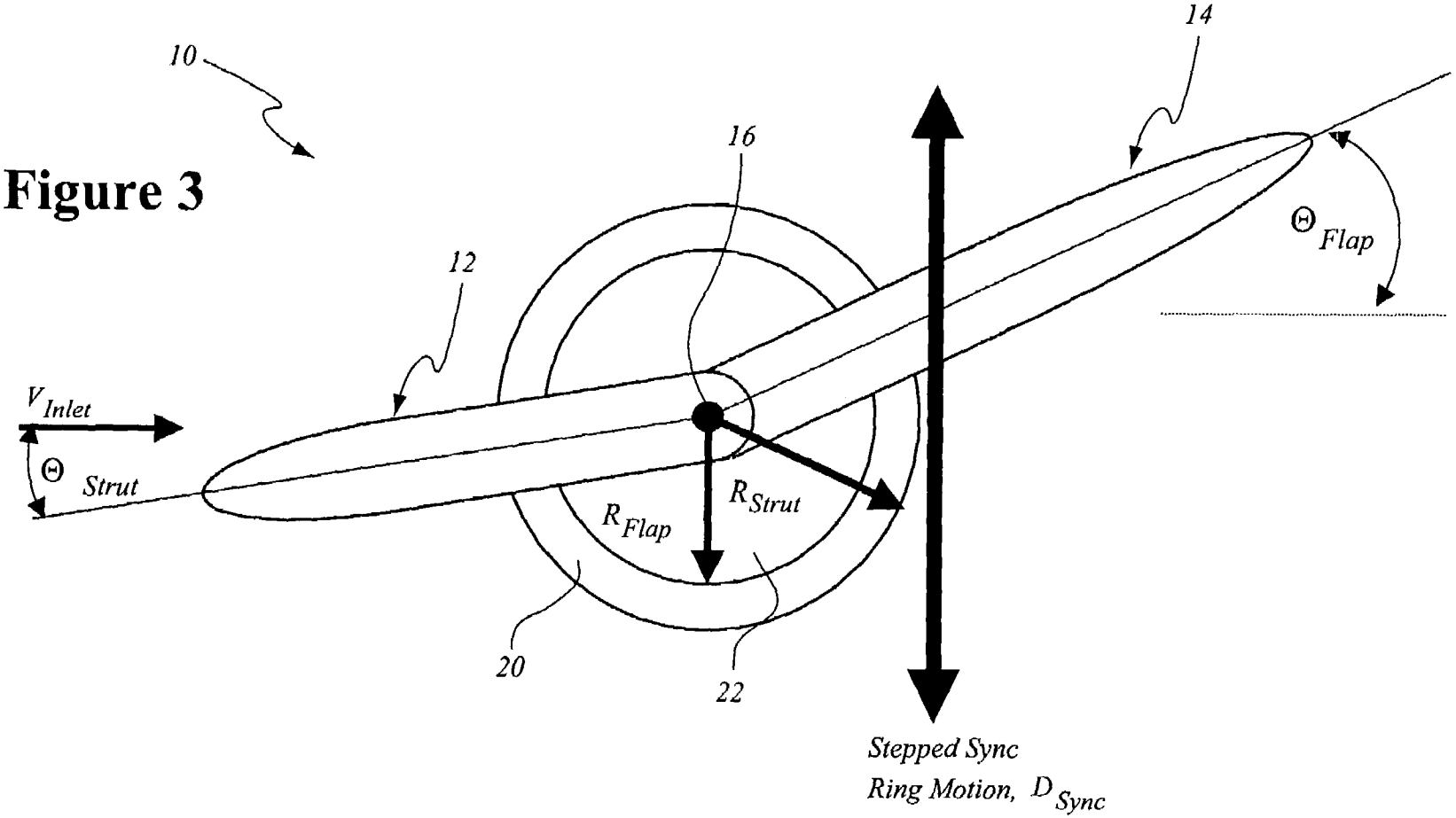
FIG. 3 is a schematic illustration similar to FIG. 1, showing variable stagger and camber airfoil geometric relationships.

Thus, referring to FIG. 3, $$\Theta_{Strut} = \frac{D_{Sync}360}{2\Pi R_{Strut}},$$

where $R_{strut}$ is the radial dimension of the strut gear and $D_{sync}$ is the arc length of the circular movement of the sync ring.

Similarly, $$\Theta_{Flap} = \frac{D_{Sync}360}{2\Pi R_{Flap}},$$

where $R_{Flap}$ is the radial dimension of the flap gear and $D_{Sync}$ again is the arc length of the circular movement of the sync ring.

Referring to FIG. 1, the stagger angle and camber angle can be determined from the strut and flap orientation as follows:

$$\Theta_{Stagger} = \tan^{-1}\left[\frac{Y_b - Y_a}{X_b - X_a}\right] \quad \Theta_{Camber} = \sin^{-1}\left[\frac{X_b Y_a - Y_b X_a}{C_{Flap} C_{Strut}}\right]$$

where $X_a$,$Y_a$ is the coordinate of the tip of the leading edge part, where $X_b$,$Y_b$ is the coordinate of the tip of the trailing edge part, $C_{Flap}$ is the length of the trailing edge part and $C_{Strut}$ is the length of the leading edge part.

The variable stagger and camber inlet guide vane airflow configuration embodying the invention provides significant benefits including reduced aerodynamic loss and power turn down operation, improved compressor operability, simplicity of execution with a common articulation axis, and ultimately requires only minor modifications to the conventional actuation system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor stator vane for a gas turbine engine comprising:

a leading edge part and a trailing edge part, each said part having a shaft-like portion extending through an outer diameter case wall of said gas turbine compressor, said leading edge part and said trailing edge part being mounted to articulate about a common, radially, oriented axis;

a strut gear for selectively varying an angle of said leading edge part with respect to an inlet air flow vector by rotating said leading edge part with respect to said axis of rotation; and a flap gear for selectively rotating said trailing edge part about said axis of rotation to vary an angle of said trailing edge part with respect to said air flow vector.

2. A compressor stator vane as in claim 1, wherein said flap gear and said strut gear have different radiuses thereby to determine a stagger to camber geometric relationship.

3. A compressor stator vane as in claim 2, further comprising a stepped, synchronous ring for being driven to position said leading edge and trailing edge parts via said respective gears.

4. A compressor stator vane as in claim 3, wherein the flap angle is determined from the stepped synchronous ring motion as follows:

$$\Theta_{Flap} = \frac{D_{Sync}360}{2\Pi R_{Flap}}$$

where $R_{Flap}$ is the radius of the flap gear and $D_{Sync}$ is the arc length of the circular movement of the stepped synchronous ring.

5. A compressor stator vane as in claim 3, wherein the strut angle is determined from the stepped synchronous ring motion as follows:

$$\Theta_{Strut} = \frac{D_{Sync}360}{2\Pi R_{Strut}}$$

where $R_{Strut}$ is the radius of the strut gear and $D_{Sync}$ is the arc length of the circular movement of the stepped synchronous ring.

6. A compressor stator vane as in claim 1, wherein the stagger angle is determined as follows:

$$\Theta_{Stagger} = \tan^{-1}\left[\frac{Y_b - Y_a}{X_b - X_a}\right],$$

where $X_a$,$Y_a$ is the coordinate of the tip of the leading edge part, and where $X_b$,$Y_b$ is the coordinate of the tip of the trailing edge part.

7. A compressor stator vane as in claim 1, wherein the camber angle is determined as follows:

$$\Theta_{Camber} = \sin^{-1}\left[\frac{X_b Y_a - Y_b X_a}{C_{Flap} C_{Strut}}\right],$$

where $X_a$,$Y_a$ is the coordinate of the tip of the leading edge part, where $X_b$,$Y_b$ is the coordinate of the tip of the trailing edge part, $C_{Flap}$ is the length of the trailing edge part and $C_{Strut}$ is the length of the leading edge part.

8. A compressor stator vane as in claim 1, wherein the shaft-like portion of the leading edge part is fitted within the shaft-like portion of the trailing edge part.

9. A method for changing stagger angle and camber angle of a compressor stator vane, comprising:

providing an airfoil including:

a leading edge part and a trailing edge part, each said part having a shaft-like portion extending through an outer diameter case wall of said gas turbine compressor, said leading edge part and said trailing edge part being mounted to articulate about a common, radially, oriented axis;

a strut gear for selectively varying an angle of said leading edge part with respect to an inlet air flow vector by rotating said leading edge part with respect to said axis of rotation; and a flap gear for selectively rotating said trailing edge part about said axis of rotation to vary an angle of said trailing edge part with respect to said air flow vector;

the method comprising driving said strut gear and said flap gear to determine a stagger angle and a camber angle of said airfoil.

10. A method as in claim 9, wherein said flap gear and said strut gear have different radii thereby to determine a stagger to camber geometric relationship.

11. A method as in claim 10, further comprising a stepped, synchronous ring for being driven to position said leading edge and trailing edge parts via said respective gears.

12. A method as in claim 11, wherein the flap angle is determined from the stepped synchronous ring motion as follows:

$$\Theta_{Flap} = \frac{D_{Sync}360}{2\Pi R_{Flap}}$$

where $R_{Flap}$ is the radius of the flap gear and $D_{Sync}$ is the arc length of the circular movement of the stepped synchronous ring.

13. A method as in claim 11, wherein the strut angle is determined from the stepped synchronous ring motion as follows:

$$\Theta_{Strut} = \frac{D_{Sync}360}{2\Pi R_{Strut}}$$

where $R_{Strut}$ is the radius of the strut gear and $D_{Sync}$ is the arc length of the circular movement of the stepped synchronous ring.

14. A method as in claim 9, wherein the stagger angle is determined as follows:

$$\Theta_{Stagger} = \tan^{-1}\left[\frac{Y_b - Y_a}{X_b - X_a}\right],$$

where $X_a$,$Y_a$ is the coordinate of the tip of the leading edge part, and where $X_b$,$Y_b$ is the coordinate of the tip of the trailing edge part.

15. A method as in claim 9, wherein the camber angle is determined as follows:

$$\Theta_{Camber} = \sin^{-1}\left[\frac{X_b Y_a - Y_b X_a}{C_{Flap} C_{Strut}}\right],$$

where $X_a$,$Y_a$ is the coordinate of the tip of the leading edge part, where $X_b$,$Y_b$ is the coordinate of the tip of the trailing edge part, $C_{Flap}$ is the length of the trailing edge part and $C_{Strut}$ is the length of the leading edge part.

16. A method as in claim 9, wherein the shaft-like portion of the leading edge part is fitted within the shaft-like portion of the trailing edge part.

* * * * *

UNITED STATES PATENT AND TRADEMARK OFFICE
Certificate

Patent No. 7,114,911 B2 Patented: October 3, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Nicholas Francis Martin, Simpsonville, SC (US); and Steven Mark Schirle, Anderson, SC (US).

Signed and Sealed this Twenty-fifth Day of November 2008.

EDWARD LOOK
*Supervisory Patent Examiner*
Art Unit 3745

UNITED STATES PATENT AND TRADEMARK OFFICE
Certificate

Patent No. 7,114,911 B2 Patented: October 3, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Nicholas Francis Martin, Simpsonville, SC (US); Steven Mark Schirle, Anderson, SC (US); and Thomas R. Tipton, Greer, SC (US).

Signed and Sealed this Ninth Day of June 2009.

EDWARD LOOK
*Supervisory Patent Examiner*
Art Unit 3745